US005148870A

United States Patent [19]

Fernandez et al.

[11] Patent Number: 5,148,870

[45] Date of Patent: Sep. 22, 1992

[54] WELL TIEBACK CONNECTOR SEALING AND TESTING APPARATUS

[75] Inventors: Randolfo Fernandez, Aberdeen; Andrew S. Mosley, Aberdeenshire, both of Scotland

[73] Assignee: ABB Vetco Gray Inc., Houston, Tex.

[21] Appl. No.: 753,532

[22] Filed: Sep. 3, 1991

[51] Int. Cl.[5] ..... E21B 33/043

[52] U.S. Cl. ..... 166/344; 166/348; 285/24; 285/93; 285/141

[58] Field of Search ..... 166/115, 340, 345, 348, 166/344, 382, 208, 339, 360; 285/18, 24, 93, 141, 208, 315, 339, 344, 380; 405/195.1

[56] References Cited

U.S. PATENT DOCUMENTS

| | | | |
|---|---|---|---|
| 4,519,633 | 5/1985 | Nichols | 285/18 X |
| 4,653,589 | 3/1987 | Alandy | 166/208 X |
| 4,696,493 | 9/1987 | Brammer | 166/345 X |
| 4,781,387 | 11/1988 | Braugh | 285/18 |
| 4,919,454 | 4/1990 | Caulfield et al. | 405/195.1 |
| 4,941,691 | 7/1990 | Reimert | 285/315 X |
| 4,976,458 | 12/1990 | Hosie et al. | 166/344 X |
| 5,080,173 | 1/1992 | Brammer | 166/208 X |

*Primary Examiner*—Ramon S. Britts
*Assistant Examiner*—Frank S. Tsay
*Attorney, Agent, or Firm*—James E. Bradley

[57] ABSTRACT

A tieback connector for a subsea well assembly has provisions to enable testing of a tieback seal without having to set any isolation seals in casing below the upper tieback member. The tieback connector has a lower tieback member with an upward facing receptacle. The lower tieback member has a set of running grooves spaced from a set of tieback grooves. An upper tieback member is lowered into the receptacle. The upper tieback member has tieback grooves that engage the tieback grooves of the lower tieback member. A lower seal on the upper tieback member engages a lower sealing area located below at least one of the sets of running grooves and tieback grooves. An upper seal located on the upper tieback member engages an upper sealing area located above at least one of the sets of the running grooves and tieback grooves. A test passage extends between the upper and lower seals. An isolation test tool is positioned in the upper tieback member, with isolation seals above and below the test passage.

20 Claims, 3 Drawing Sheets

WELL TIEBACK CONNECTOR SEALING AND TESTING APPARATUS

BACKGROUND OF THE INVENTION

1. Field of the invention

This invention relates in general to a tieback apparatus for a subsea well, and in particular to a means for sealing the tieback connector and testing the seal.

2. Description of the Prior Art

When drilling a subsea well, mudline tieback connections are employed, particularly for exploratory wells. In a mudline tieback connection, rather than utilize a subsea pressure containing wellhead, all of the casing strings will extend to the drilling rig. The pressure control will thus be at the drilling rig rather than subsea. Tieback connectors will be located at the subsea wellhead housing to connect the casing strings that are cemented in place to tieback strings that extend to the surface drilling vessel.

If a well is be produced, the operator may temporarily abandon the well after drilling by removing the tieback strings extending from the casing strings to the surface. The operator will place a cap on the subsea structure until he later returns for running production equipment.

The tieback connector for each string includes an upward facing tubular tieback member located at the subsea wellhead at the upper end of each casing string that will serve subsequently to be connected to a tieback string for production. This lower tieback member has a set of running grooves, normally left-hand threads, that were utilized when the casing string was initially run. Also, the lower tieback member will have a set of tieback grooves, which may be threads or grooves, for securing to a subsequent tieback string when it is desired to complete the well for production.

When it is desired to complete the wells for production, the operator will position a production platform over the well or wells. The operator removes the cap from the lower tieback member and lowers a tieback string back into engagement with the lower tieback member. The tieback string has an upper tubular tieback member on its lower end that stabs into and latches with the lower tieback member. The upper and lower tieback members have a seal that seals the connection from the annulus and bore. The upper and lower tieback members make up the tieback connector.

Then, the operator must test the tieback connection to assure that the tieback connector does not leak to the annulus. In the past, an operator would lower an isolation test tool which had an upper elastomeric seal and a lower elastomeric seal. He would set the upper seal in the upper tieback member bore and the lower seal in the casing below the lower tieback member. The operator would apply pressure to this area to determine if leakage exists.

One problem with this test is that the lower seal of the isolation tool must engage an internal bore within the casing in an area that has been previously contacted by a drill pipe. This surface may be damaged and difficult to seal against. Consequently, it is difficult to obtain an accurate test.

SUMMARY OF THE INVENTION

In this invention, a tieback connector is provided that has provisions for enabling testing after the upper tieback member is latched into the lower tieback member.

The tieback connector has conventional running grooves and tieback grooves for latching together. At least one sealing area is located in the lower tieback member below at least one of the sets of running grooves and tieback grooves. An upper sealing area is located in the lower tieback member above the lower sealing area and above at least one of the sets of running grooves and tieback grooves. The upper tieback member has upper and lower seals for mating with the upper and lower sealing areas on the lower tieback member. The upper and lower seals and sealing areas will seal between the upper and lower tieback members once made up.

A test passage is located between the upper and lower seals. This test passage extends from the axial passage of the upper tieback member to the exterior of the upper tieback member.

An isolation test tool is lowered into the assembly. The isolation test tool has an upper seal that seals above the test passage and a lower seal that seals in the upper tieback member below the test passage. Both of the areas engaged by the isolation test seals are undamaged sealing surfaces. The operator applies pressure through the isolation test tool to determine if either the upper and lower seals between the tieback members leaks.

DETAILED DESCRIPTION OF THE INVENTION

Figure 1:
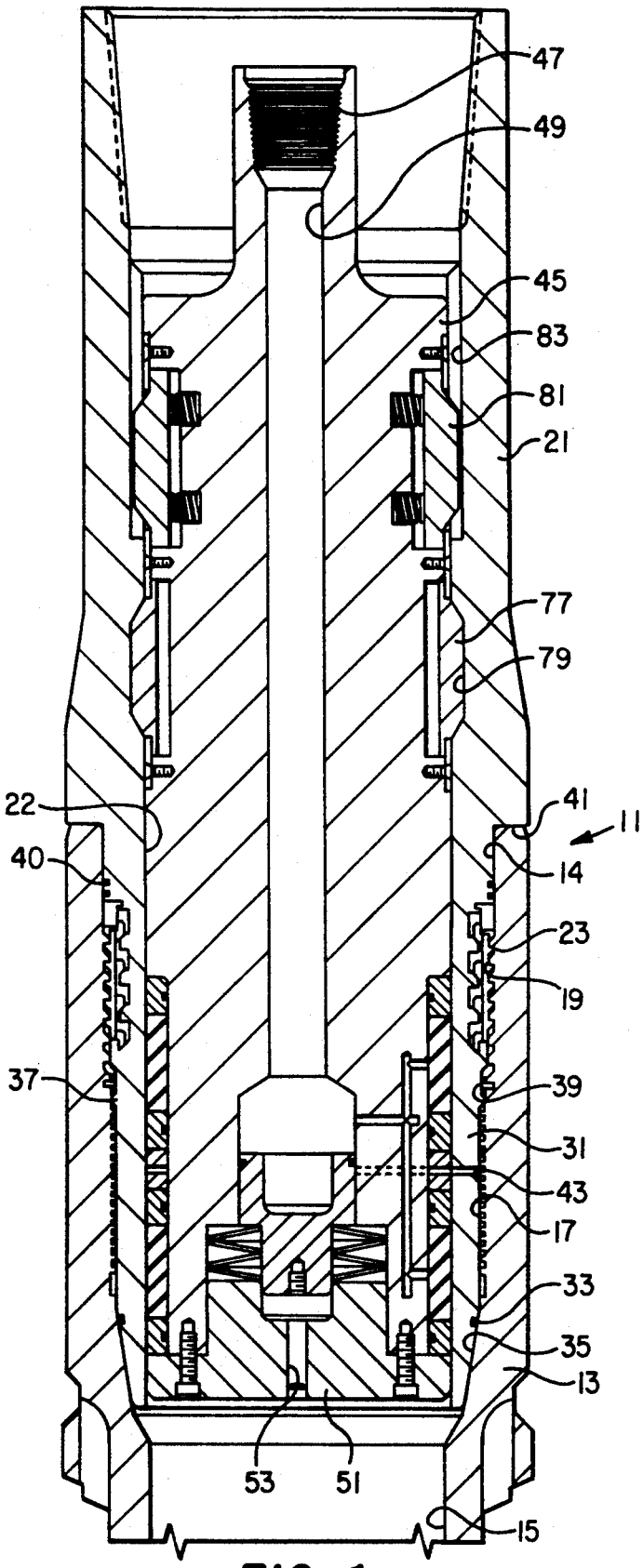
FIG. 1 is a sectional view illustrating a tieback connector constructed in accordance with this invention, and further showing an isolation test tool located within the tieback connector.

Referring to FIG. 1, tieback connector 11 includes a lower tieback member 13 extending upward from the sea floor. Lower tieback member 13 will be supported within a wellhead (not shown) and will face upward. Lower tieback member 13 will be secured to a string of casing (not shown) extending into the well. The lower tieback member 13 has an axial passage 15 and a receptacle 14 on its upper end. The lower tieback member 13 would have been initially secured to a string of casing (not shown) and lowered into the well by a running tool (not shown). The running tool would be connected to the lower end of a string of pipe extending to the drilling platform and would remain in engagement during further drilling operations. The running tool would be retrieved when the well is temporarily abandoned.

Receptacle 14 is of a larger diameter than the lower portion of bore 15 and has a set of running grooves 17 and a set of tieback grooves 19. Running grooves 17 are shown to be located below the tieback grooves 19. Running grooves 17 and tieback grooves 19 may be of various types of engagement profiles used in tieback connectors. In the embodiment shown, the running grooves 17 comprise a helical left-hand thread. The tieback grooves 19 comprise a right-hand helical thread. The inner diameter of the tieback grooves 19 is larger than the inner diameter of the running grooves 17. During the initial running of the lower tieback member 13, a running tool will engage the running grooves 17, and the tieback grooves 19 will not be utilized. During the tieback operation, the tieback grooves 19 are utilized and the running grooves 17 are not utilized.

During the subsequent tieback operation, an upper tieback member 21 will be lowered into the receptacle 14 of the lower tieback member 13. Upper tieback member 21 will be secured to the lower end of a string of casing (not shown), which extends to a platform at the surface. Upper tieback member 21 has an axial bore 22.

Upper tieback member 21 carries a metal split ring or latch 23 that ratchets into the tieback grooves 19 to secure the members together. Latch 23 is keyed to the upper tieback member 21 for rotation therewith. The upper tieback member 21 will latch into place, then a slight amount of rotation of the upper tieback member 21 will lock the tieback members 13, 21 together. Latch 23 has external threads 25 (FIG. 2) and internal back up shoulders 27. The back up shoulders 27 engage shoulders 29 located on the exterior of upper tieback member 21. Latch 25 be of various types, but is shown to be the type that is described in U.S. Pat. No. 4,607,865, David W. Hughes, Aug. 26, 1986.

Upper tieback member 21 has a nose 31 that extends into the lower tieback member 13. Nose 31 has a lower seal 33 located on nose 31. Seal 33 is a tapered or conical metal seal, having also an elastomer. Seal 33 mates with a conical smooth lower seal area 35 located in the receptacle 14. The lower sealing area 35 at its minimum has a greater diameter than the inner diameter of the bore 15 located below receptacle 14. The prior running tool (not shown) for the lower tieback member 13 would provide protection for the lower seal area 35 during drilling operations conducted through the lower tieback member 13. The engagement of the lower tieback seal 33 and the lower sealing area 35 is an interference, metal-to-metal engagement.

Figure 4:
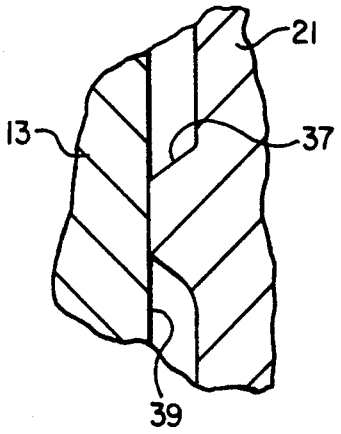
FIG. 4 is a partial enlarged view of the upper seal and sealing area for the tieback connector of FIG. 1.

The upper tieback member 21 also has an upper tieback seal 37. Upper tieback seal 37 is positioned to engage an upper sealing area 39 located between the running threads 17 and the tieback threads 19. Referring to FIG. 4, the upper tieback seal 37 is preferably of a metal-to-metal type but could be of various types. Preferably it comprises an annular band 37 that protrudes out and interferingly engages the upper sealing area 39. The upper sealing area 39 is preferably a smooth cylindrical surface. The upper sealing area 39 has an inner diameter that is greater than the crest diameter of the running threads 17. During drilling operations, the running tool (not shown) will be engaging the running threads 17 and thus will protect the upper sealing area 39 from damage of any drill pipe. An elastomeric seal 40 is located above upper seal 37 and above latch 23 for engaging the bore 15 at the upper end of receptacle 14.

Referring again to FIG. 1, when the upper tieback member 21 fully engages the lower tieback member 13, make-up shoulders 41 will engage each other, limiting further downward travel of the upper tieback member 21. A test passage 43 extends from the bore 22 of upper tieback member 21 radially outward to the exterior of upper tieback member 21. Test passage 43 is located between the upper tieback seal 37 and the lower tieback seal 33. Test passage 43 thus will align with the running threads 17 when the upper tieback member 21 has fully engaged the lower tieback member 13. Test passage 43 in the preferred embodiment does not contain any check valves, rather remains continuously open.

Once the tieback members 21, 13 have latched into place, the operator will lower an isolation test tool 45 on drill pipe (not shown) into bore 22 of upper tieback member 21. Isolation test tool 45 may be of various types. In the preferred embodiment, isolation test tool 45 has threads 47 on its upper end for securing to the drill pipe (not shown). Isolation test tool 45 has an axial passage 49 extending through it that coincides with the longitudinal axis of the upper tieback member 21. Isolation test tool 45 has a cap 51 on its lower end. A fluid displacement passage 53 extends through cap 51.

Isolation test tool 45 has an upper isolation seal 55 and a lower isolation seal 57. Isolation seals 55, 57 are large elastomeric seals for engaging the bore 22 of the upper tieback member 21. When landed into place, upper isolation seal 55 will locate above test passage 43, and lower isolation seal 57 will locate below test passage 43. The isolation seals 55, 57 engage a smooth sealing surface formed in bore 22. As the upper tieback member 21 has not received any drill pipe during any earlier drilling operations, these surfaces will be undamaged due to engagement with any drilling equipment.

Figure 2:
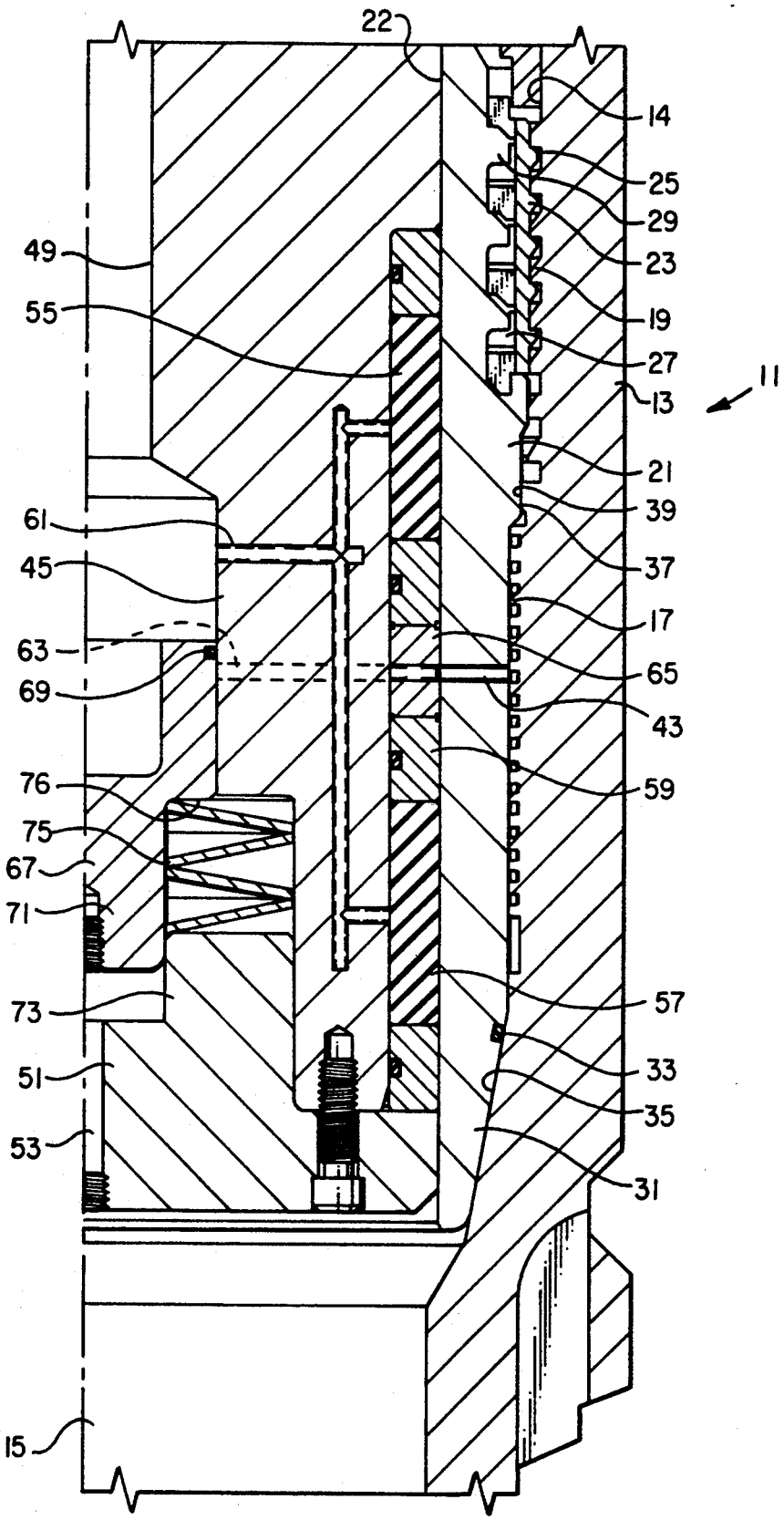
FIG. 2 is a partial enlarged sectional view of a portion of the tieback connector of FIG. 1, showing the isolation test tool prior to energizing the test seals.

As shown in FIG. 2, the upper and lower isolation seals 55, 57 each have compression rings 59 spaced above and below them. Compression rings 59 are metal rings used to deform the seals 55, 57 when pressure is applied to the inner diameters of the seals 55, 57. Energizing passages 61 extend from the isolation tool axial passage 49 to the inner diameters of each of the isolation seals 55, 57. Energizing passages 61 are used to convey fluid pumped down the drill pipe to the isolation seals 55, 57 to cause them to deform into tight sealing engagement.

A communication passage 63 extends radially from isolation tool axial passage 49. Communication passage 63 extends through the body of isolation test tool 45 and through a spacer ring 65 located on the exterior of the body of isolation test tool 45. Communication passage 63 does not join the energizing passages 61. When isolation test tool 45 is installed at the proper test position, communication passage 63 will be aligned with the test passage 43. This allows fluid pumped down the drill string to flow through the communication passage 63 and test passage 43 into the annular space between the upper and lower tieback seals 33, 37.

Figure 3:
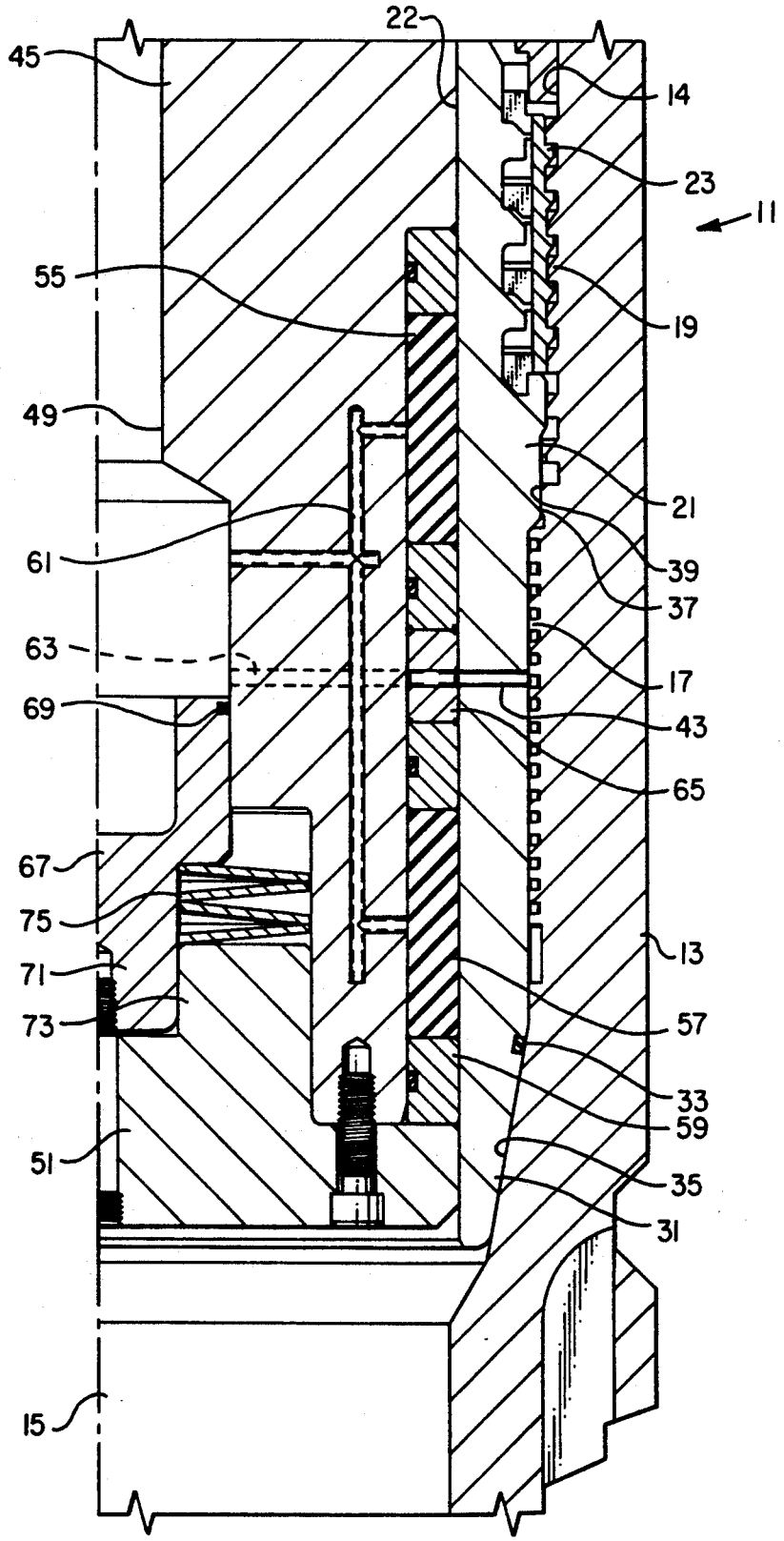
FIG. 3 is a partial enlarged sectional view similar to FIG. 4, but showing the isolation test tool seals energized and showing test pressure being applied.

In the preferred embodiment, a valve 67 will block the communication passage 63 until the isolation seals 55, 57 have been fully energized by pressure from the drill pipe. Valve 67 is a cup shaped element that has a seal 69 on its exterior for sealing in the test tool passage 49. Seal 69 will in all cases be located below the energizing passage 61. While the valve 67 is in the upper position, as shown in FIG. 1, seal 69 will be located above communication passage 63. Valve 67 will move axially between the upper position shown in FIG. 2 and the lower position shown in FIG. 3.

Valve 67 has a lower portion 71 that extends into a socket 73 provided in the upper end of cap 51. A series of belleville springs 75 locate between cap 51 and a downward facing shoulder 76 from valve 67. When moving to the lower position shown in FIG. 3, the springs 75 compress and urge the valve 67 back toward the upper position. The pressure of the fluid pumped down the axial passage 49 from the platform will force the valve 67 to the lower position once the pressure reaches a minimum level. At that minimum level, the isolation seals 55, 57 will be fully energized.

Referring again to FIG. 1, the isolation test tool 45 will latch into the upper tieback member 21 in various manners. In the embodiment shown, the tool has a split ring 77 that engage a recess 79 to locate the isolation test tool 45 at the proper position. Similarly, spring-biased keys 81 located above split ring 77 engage splines 83 in the upper tieback member 21. Keys 81 engage splines 83 to permit engagement rotation of the upper tieback member 21 into the lower tieback member 13 through torque applied with the drill pipe and torque test tool 45.

In operation, the lower tieback member 13 will have previously been connected to a string of casing (not shown), lowered into the sea, and the casing cemented into place. During that procedure, the running tool (not shown) for the lower tieback member 13 will have engaged the running threads 17. Normally, further drilling operations would have been performed through the casing and the lower tieback member 13. After drilling operations are completed, the running string will be removed. This leaves the lower tieback member 13 at the subsea well. A cap may be installed.

When the operator wishes to tieback for production, he will lower the upper tieback member 21 on a string of casing (not shown). The upper tieback member 21 will insert into the lower tieback member 13. Latch 23 will latch the members 21, 13 together. A slight amount of rotation will make a tight makeup. The lower tieback seal 33 will engage the lower sealing area 35. The upper tieback seal 37 will engage the upper sealing area 39. Shoulders 41 will also engage each other.

Then, the operator lowers the isolation test tool 45 on a string of conduit into the bore 22 of upper tieback 21. Split ring 77 and keys 81 will engage the recess 79 and splines 83, respectively. The operator then applies pressure to the isolation tool passage 49 by pumping fluid down the drill pipe from the platform. This fluid flows through the energizing passages 61, shown in FIG. 2, to cause the isolation seals 55, 57 to sealingly engage the upper tieback member bore 22 above and below the test passage 43.

Once the pressure through axial passage 49 has reached a sufficient amount, valve 67 will move downward. This exposes the communication passage 63. Then, the fluid will flow through the test passage 43 to the annular space between the tieback seals 33, 37. The operator will monitor the annulus surrounding the tieback connection 11 to determine if any leakage past the upper tieback seal 37 and past seals 40 exist. If not, the operator releases the tieback pressure and removes the isolation test tool 45.

During further operations, the upper tieback seal 37 will serve as the seal to prevent flow from the upper tieback member bore 22 to the exterior of the tieback connection 11. The lower tieback seal 33 will have no further function because the test passage 43 will remain open during further operations.

The invention has significant advantages. The tieback connector enables a test tool to isolate and test a tieback connection seal without having to seal in the bore of the lower tieback member or in casing below the lower tieback member receptacle. The isolation test tool seals need only seal against smooth new surfaces in the upper tieback member, which will not have been damaged by drilling equipment during earlier operations. The valve located in the isolation test tool assures that the isolation test seals are properly energized before pressure is supplied for testing.

While the invention has been shown in only one of its forms, it should be apparent to those skilled in the art that it is not so limited, but is susceptible to various changes without departing from the scope of the invention.

We claim:

1. In a tieback connector for a subsea well assembly of a type having a lower tieback member adapted to face upward from a sea floor for receiving a downward facing upper tieback member lowered from a platform, the upper tieback member having an axial passage therethrough, the lower tieback member having a set of running grooves axially spaced from a set of tieback grooves, the upper tieback member having connection means for engaging the tieback grooves to connect the upper tieback member to the lower tieback member, an improved means for sealing and testing the connection of the tieback members, comprising in combination:

a lower sealing area located in the lower tieback member below at least one of the sets of running grooves and tieback grooves;

an upper sealing area located in the lower tieback member above the lower sealing area and above at least one of the sets of running grooves and tieback grooves;

a lower seal located on a lower portion of the upper tieback member and positioned to sealingly engage the lower sealing area;

an upper seal located on the upper tieback member above the lower seal and positioned to sealingly engage the upper sealing area; and a test passage located between the lower and upper seals and extending from the axial passage of the upper tieback member to the exterior of the upper tieback member, to allow test pressure to be applied between the upper and lower seals while engaging the upper and lower sealing areas, respectively.

2. The tieback connector according to claim 1 wherein the lower sealing area is located below both of the sets of the running grooves and tieback grooves.

3. The tieback connector according to claim 1 wherein the lower sealing area is located below both of the sets of the running grooves and tieback grooves, and wherein the upper sealing area is located between the sets of running grooves and tieback grooves.

4. A tieback connector for a subsea well assembly, comprising in combination:

a lower tieback member adapted to face upward from a sea floor;

a downward facing upper tieback member having an axial passage therethrough and adapted to be lowered from a platform into the lower tieback member;

a set of running grooves in the lower tieback member for connection to a string for running the lower tieback member;

a set of tieback grooves located in the lower tieback member and axially spaced from the running grooves;

connection means on the upper tieback member for engaging the tieback grooves to connect the upper tieback member to the lower tieback member;

a lower sealing area located in the lower tieback member below both the running grooves and tieback grooves;

an upper sealing area located in the lower tieback member between the running grooves and tieback grooves;

a lower seal located on a lower portion of the upper tieback member below the connection means and positioned to sealingly engage the lower sealing area;

an upper seal located on the upper tieback member above the lower seal and positioned to sealingly engage the upper sealing area; and a test passage located between the lower and upper seals and extending from the axial passage of the upper tieback member to the exterior of the upper tieback member, to allow test pressure to be applied between the upper and lower seals while engaging the upper and lower sealing areas, respectively.

5. The tieback connector according to claim 4 wherein the lower sealing area is a metal tapered surface.

6. The tieback connector according to claim 4 wherein the upper sealing area is a metal cylindrical surface.

7. The tieback connector according to claim 4 wherein the upper seal is located below the connection means.

8. The tieback connector according to claim 4 wherein the running grooves are located below the tieback grooves.

9. The tieback connector according to claim 4 wherein the lower sealing area is a metal tapered surface and wherein the upper sealing area is a metal cylindrical surface having an inner diameter that is greater than a minimum inner diameter of the lower sealing area.

10. In a subsea well assembly of a type having a lower tieback member adapted to face upward from a sea floor for receiving a downward facing upper tieback member lowered from a platform, the upper tieback member having an axial passage therethrough, the lower tieback member having a set of running grooves axially spaced from a set of tieback grooves, the upper tieback member having connection means for engaging the tieback grooves to connect the upper tieback member to the lower tieback member, an improved apparatus for sealing and testing the connection of the tieback members, comprising in combination:

a lower sealing area located in the lower tieback member below at least one of the sets of running grooves and tieback grooves;

an upper sealing area located in the lower tieback member above the lower sealing area and above at least one of the sets of running grooves and tieback grooves;

a lower seal located on a lower portion of the upper tieback member and positioned to sealingly engage the lower sealing area;

an upper seal located on the upper tieback member above the lower seal and positioned to sealingly engage the upper sealing area;

a test passage located between the lower and upper seals and extending from the axial passage of the upper tieback member to the exterior of the upper tieback member; and isolation test tool means adapted to be lowered on a string of conduit into the axial passage of the upper tieback member for applying test pressure to the test passage while the upper and lower seals are engaging the upper and lower sealing areas, respectively, to determine if any leakage past the upper seal exists.

11. The apparatus according to claim 10 wherein the lower sealing area is located below both of the sets of the running grooves and tieback grooves.

12. The apparatus according to claim 10 wherein the lower sealing area is located below both of the sets of the running grooves and tieback grooves, and wherein the upper sealing area is located between the sets of running grooves and tieback grooves.

13. The apparatus according to claim 10 wherein the isolation test tool means comprises:

a tubular body having an axial passage;

upper and lower seal means on the exterior of the tubular body for sealing against the axial passage of the upper tieback member at points above and below the test passage, respectively;

a communication passage leading from the axial passage of the tubular body to the exterior between the upper and lower seal means for supplying fluid pumped down the axial passage of the tieback member to the test passage; and means in the axial passage of the tubular body for preventing flow out the axial passage below the tubular body.

14. In a subsea well assembly of a type having a lower tieback member adapted to face upward from a sea floor for receiving a downward facing upper tieback member lowered from a platform, the upper tieback member having an axial passage therethrough, the lower tieback member having a set of running grooves axially spaced from a set of tieback grooves, the upper tieback member having connection means for engaging the tieback grooves to connect the upper tieback member to the lower tieback member, an improved apparatus for sealing and testing the connection of the tieback members, comprising in combination:

a lower sealing area located in the lower tieback member below at least one of the sets of running grooves and tieback grooves;

an upper sealing area located in the lower tieback member above the lower sealing area and above at least one of the sets of running grooves and tieback grooves;

a lower tieback seal located on a lower portion of the upper tieback member and positioned to sealingly engage the lower sealing area;

an upper tieback seal located on the upper tieback member above the lower tieback seal and positioned to sealingly engage the upper sealing area;

a test passage located between the lower and upper tieback seals and extending from the axial passage of the upper tieback member to the exterior of the upper tieback member;

a tubular body having an axial passage, the tubular body being adapted to be secured to a string of conduit and lowered from the platform into the upper tieback member;

upper and lower isolating seals on the exterior of the tubular body;

an energizing passage leading from the axial passage of the tubular body to the upper and lower isolating seals, respectively, for delivering fluid to the upper and lower isolating seals to cause the upper and lower isolating seals to seal against the axial passage of the upper tieback member at points above and below the test passage, respectively; and a communication passage leading from the axial passage of the tubular body to the exterior of the tubular body between the upper and lower isolating seals for supplying fluid pumped down the axial passage of the tieback member to the test passage between the upper and lower tieback seals while engaging the upper and lower sealing areas, respectively, to determine if any leakage past the upper tieback seal exists.

15. The apparatus according to claim 14 wherein the lower sealing area is located below both of the sets of the running grooves and tieback grooves.

16. The apparatus according to claim 14 wherein the lower sealing area is located below both of the sets of the running grooves and tieback grooves and wherein the upper sealing area is located between the sets of running grooves and tieback grooves.

17. The apparatus according to claim 14 further comprising:

valve means for preventing flow through the communication passage until pressure in the energizing passage has reached a selected minimum to assure that the upper and lower isolation seals are in sealing engagement with the axial passage of the upper tieback member before fluid flows through the communication passage.

18. The apparatus according to claim 17 wherein the valve means comprises:

a valve carried in the axial passage of the tubular body, the valve having a closed lower end to block flow out the axial passage of the tubular body;

seal means on the valve for engaging the axial passage of the tubular body;

the valve being movable between an upper position wherein the seal means locates above the communication passage and below the energizing passage to allow flow through the energizing passage but not through the communication passage, to a lower position wherein the seal means locates below the energizing passage to allow flow both through the energizing passage and through the communication passage; and spring means for urging the valve to the upper position and for allowing the valve to move to the lower position when a selected pressure in the axial passage of the tubular body is reached.

19. A method for connecting and testing a tieback connection in a subsea well assembly of a type having a lower tieback member adapted to face upward from a sea floor, the lower tieback member having a set of running grooves axially spaced from a set of tieback grooves, the method comprising:

providing a lower sealing area in the lower tieback member below at least one of the sets of running grooves and tieback grooves;

providing an upper sealing area in the lower tieback member above the lower sealing area and above at least one of the sets of running grooves and tieback grooves;

providing an upper tieback member with an axial passage therethrough and connection means for engaging the tieback grooves;

providing a lower seal on a lower portion of the upper tieback member and positioning the lower seal to sealingly engage the lower sealing area;

providing an upper seal on an upper portion of the tieback member above the lower seal and positioning the upper seal to sealingly engage the upper sealing area;

providing a test passage between the lower and upper seals and extending from the axial passage of the upper tieback member to the exterior of the upper tieback member;

connecting the upper tieback member to a string of conduit and lowering the upper tieback member into the lower tieback member;

connecting the upper tieback member to the lower tieback member with the connection means;

engaging the upper and lower seals with the upper and lower sealing areas, respectively; then lowering an isolation test tool into the axial passage of the upper tieback member;

sealing the isolation test tool in the axial passage at points above and below the test passage; and applying test pressure from the isolation test tool to the test passage and monitoring the exterior of the tieback connection to determine if any leakage past the upper seal exists.

20. The method according to claim 19 wherein the step of sealing the isolation test tool in the axial passage comprises:

mounting isolation seals on the isolation test tool;

positioning the isolation seals above and below the test passage; then applying fluid pressure from the isolation test tool to the isolation seals to cause the isolation seals to seal against the axial passage in the isolation test tool; then applying the test pressure from the isolation test tool to the test passage.

* * * * *